US009347415B2

(12) United States Patent
Philippart et al.

(10) Patent No.: US 9,347,415 B2
(45) Date of Patent: May 24, 2016

(54) DRIVER OUTPUT ENCODING SYSTEMS AND METHODS

(71) Applicant: GM Global Technology Operations LLC, Detroit, MI (US)

(72) Inventors: Timothy P. Philippart, Orion, MI (US); Shawn L. Boozer, Clarkston, MI (US); Scott J. Chynoweth, Davison, MI (US); Detlev Schafer, Dexheim (DE)

(73) Assignee: GM Global Technology Operations LLC, Detroit, MI (US)

( * ) Notice: Subject to any disclaimer, the term of this patent is extended or adjusted under 35 U.S.C. 154(b) by 273 days.

(21) Appl. No.: 14/200,529

(22) Filed: Mar. 7, 2014

(65) Prior Publication Data

US 2015/0211467 A1 Jul. 30, 2015

Related U.S. Application Data

(60) Provisional application No. 61/931,205, filed on Jan. 24, 2014.

(51) Int. Cl.

| | |
|---|---|
| ***F02N 11/08*** | (2006.01) |
| *F02N 15/02* | (2006.01) |
| *F02N 15/06* | (2006.01) |

(52) U.S. Cl.

CPC ..... *F02N 11/087* (2013.01); *F02N 11/0814* (2013.01); *F02N 11/0862* (2013.01); *F02N 15/022* (2013.01); *F02N 15/067* (2013.01); *F02N 2300/2011* (2013.01)

(58) Field of Classification Search

CPC ..... F02D 41/06; F02D 41/062; F02D 41/068; F02N 11/08; F02N 11/0811; F02N 11/0814; F02N 11/0818; F02N 11/087

USPC ..... 123/179.1, 179.3, 179.4, 179.24, 123/179.25, 185.12; 701/105, 112, 113

See application file for complete search history.

(56) References Cited

U.S. PATENT DOCUMENTS

| | | | | |
|---|---|---|---|---|
| 2005/0145209 | A1* | 7/2005 | Denz | F02N 11/087 123/179.3 |
| 2013/0066541 | A1* | 3/2013 | Schueler | F02N 11/0814 701/113 |
| 2014/0372013 | A1* | 12/2014 | Shimizu | F02N 11/008 701/112 |

* cited by examiner

*Primary Examiner* — John Kwon
*Assistant Examiner* — Johnny H Hoang

(57) ABSTRACT

A starter relay connects a battery with a starter motor of an engine when in a closed state and disconnects the starter motor from the battery when in an open state. A switching device provides current to the starter relay when in a closed state and disables current flow to the starter relay when in an open state. For an engine startup event, a switch control module: transitions the switching device to the closed state for a first predetermined period; transitions the switching device to the open state for a second predetermined period after the first predetermined period; and transitions the switching device to the closed state for a third period after the second predetermined period. The starter relay remains in the open state during the first predetermined period and transitions to the closed state when the switching device is in the closed state for the third period.

20 Claims, 5 Drawing Sheets

DRIVER OUTPUT ENCODING SYSTEMS AND METHODS

CROSS-REFERENCE TO RELATED APPLICATIONS

This application claims the benefit of U.S. Provisional Application No. 61/931,205, filed on Jan. 24, 2014. The disclosure of the above application is incorporated herein by reference in its entirety.

FIELD

The present application relates to internal combustion engines and more particularly to systems and methods for encoding an output of a driver to indicate future action.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An engine combusts an air/fuel mixture to generate drive torque for a vehicle. The air is drawn into the engine through a throttle valve and an intake manifold. The fuel is provided by one or more fuel injectors. The air/fuel mixture is combusted within one or more cylinders of the engine. Combustion of the air/fuel mixture may be initiated by, for example, injection of the fuel and/or spark provided by a spark plug. Combustion of the air/fuel mixture produces exhaust. The exhaust is expelled from the cylinders to an exhaust system.

An engine control module (ECM) controls the torque output of the engine. For example only, the ECM controls the torque output of the engine based on driver inputs and/or other inputs. The driver inputs may include, for example, an accelerator pedal position, a brake pedal position, inputs to a cruise control system, and/or other driver inputs. The other inputs may include inputs from various vehicle systems, such as a transmission control system.

A vehicle may include an auto-start/stop system that increases the vehicle's fuel efficiency. The auto-start/stop system increases fuel efficiency by selectively shutting down the engine while the vehicle is running, but is stopped or slowing. While the engine is shut down, the auto-stop/start system selectively starts up the engine when one or more start-up conditions are satisfied.

SUMMARY

In a feature, a starter control system for a vehicle is described. A starter relay connects a battery with a starter motor of an engine when in a closed state and disconnects the starter motor from the battery when in an open state. A switching device provides current to the starter relay when in a closed state and disables current flow to the starter relay when in an open state. For an engine startup event, a switch control module: transitions the switching device to the closed state for a first predetermined period; transitions the switching device to the open state for a second predetermined period after the first predetermined period; and transitions the switching device to the closed state for a third period after the second predetermined period. The starter relay remains in the open state during the first predetermined period and transitions to the closed state when the switching device is in the closed state for the third period.

In further features, starter motor drives a crankshaft of the engine when the starter relay is in the closed state.

In still further features: a voltage stabilization device that receives a first voltage from the battery and that generates a second voltage based on the first voltage; and an electronic device that operates based on the second voltage.

In yet further features, a triggering module that generates a trigger signal based on an output of the switching device; and a converter control module that controls the voltage stabilization device when the trigger signal is generated.

In further features, a filter module receives the output of the switching device and applies a filter to the output to generate a filtered output. The triggering module generates the trigger signal based on the filtered output.

In still further features, the triggering module generates the trigger signal when the filtered output is greater than a predetermined value.

In yet further features, the filter includes a low pass filter.

In further features, the converter control module controls the voltage stabilization device based on a target voltage.

In still further features, the converter control module controls the voltage stabilization device based on the first voltage.

In yet further features, the voltage stabilization device includes a direct current (DC) to DC converter.

In a feature, a method for a vehicle includes: using a starter relay, connecting a battery with a starter motor of an engine when the starter relay is in a closed state and disconnecting the starter motor from the battery when the starter relay is in an open state; and, using a switching device, providing current to the starter relay when the starter relay is in a closed state and disabling current flow to the starter relay when the starter relay is in an open state. The method further includes, for an engine startup event: transitioning the switching device to the closed state for a first predetermined period; transitioning the switching device to the open state for a second predetermined period after the first predetermined period; and transitioning the switching device to the closed state for a third period after the second predetermined period. The starter relay remains in the open state during the first predetermined period and transitions to the closed state when the switching device is in the closed state for the third period.

In further features, the method further includes, using the starter motor, driving a crankshaft of the engine when the starter relay is in the closed state.

In still further features, the method further includes, using a voltage stabilization device: receiving a first voltage from the battery; generating a second voltage based on the first voltage; and outputting the second voltage to an electronic device that operates based on the second voltage.

In yet further features, the method further includes: generating a trigger signal based on an output of the switching device; and controlling the voltage stabilization device when the trigger signal is generated.

In further features, the method further includes: applying a filter to an output of the switching device to generate a filtered output; and generating the trigger signal based on the filtered output.

In still further features, the method further includes generating the trigger signal when the filtered output is greater than a predetermined value.

In yet further features, the filter includes a low pass filter.

In further features, the method further includes controlling the voltage stabilization device based on a target voltage.

In still further features, the method further includes controlling the voltage stabilization device based on the first voltage.

In yet further features, the method further includes voltage stabilization device includes a direct current (DC) to DC converter.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

An engine outputs torque to a transmission via a crankshaft. A flywheel is coupled to and rotates with the crankshaft. A starter is selectively engaged with the flywheel to start the engine. The engine may be started, for example, when the driver initiates vehicle startup. The engine may also be started after being shut down while the vehicle is running for an auto-stop/start event.

When a starter relay is in a closed state, the starter draws power from a battery via the starter relay to start the engine. The large current flow to the starter motor will cause a voltage drop across wiring and interconnects that are in the current path. A voltage stabilization device, such as a direct current (DC) to DC converter is also connected to the battery. The voltage stabilization device receives a first voltage from the battery and converts the first voltage into a second voltage. The second voltage is supplied to one or more electronic devices of the vehicle.

A converter control module controls the voltage stabilization device to adjust the second voltage toward a target voltage. Use of the starter to start the engine, however, decreases the first voltage. If the decrease is not anticipated by the converter control module, the converter control module may be unable to adjust the second voltage to the target voltage.

According to the present disclosure, a signal of the upcoming use of the starter motor (and the resulting decrease in the first voltage) is applied to the starter relay. The signal is insufficient to close the starter relay. The converter control module also receives the signal. In response to the signal, the converter control module prepares to control the voltage stabilization device and to compensate for the upcoming decrease in the first voltage.

Figure 1:
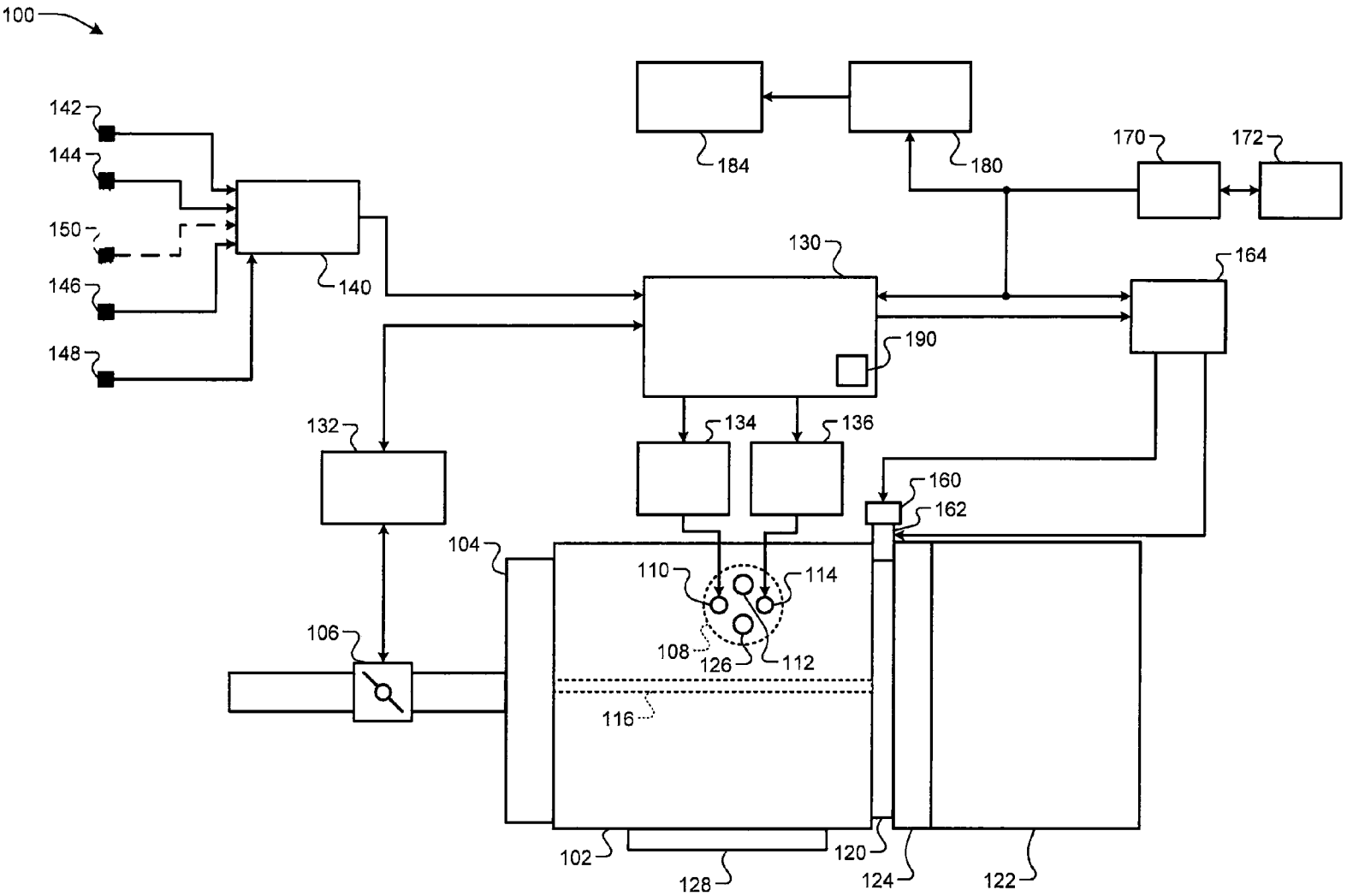
FIG. 1 is a functional block diagram of an example engine system according to the present disclosure.

Referring now to FIG. 1, a functional block diagram of an example engine system 100 is presented. The engine system 100 includes an engine 102 that combusts an air/fuel mixture to produce drive torque for a vehicle. Air is drawn into an intake manifold 104 through a throttle valve 106. The throttle valve 106 regulates air flow into the intake manifold 104. Air within the intake manifold 104 is drawn into one or more cylinders of the engine 102, such as cylinder 108.

One or more fuel injectors, such as fuel injector 110, inject fuel that mixes with air to form an air/fuel mixture. In various implementations, one fuel injector may be provided for each cylinder of the engine 102. One or more intake valves, such as intake valve 112, open to allow air into the cylinder 108. A piston (not shown) compresses the air/fuel mixture within the cylinder 108. In some engine systems, a spark plug 114 initiates combustion of the air/fuel mixture within the cylinder 108. In other engine systems, such as diesel engine systems, combustion may be initiated without the spark plug 114.

Combustion of the air/fuel mixture applies force to the piston, and the piston rotatably drives a crankshaft 116. The engine 102 outputs torque via the crankshaft 116. A flywheel 120 is coupled to and rotates with the crankshaft 116. Torque output by the engine 102 is selectively transferred to a transmission 122 via a torque transfer device 124. More specifically, the torque transfer device 124 selectively couples the transmission 122 to the engine 102 and de-couples the transmission 122 from the engine 102. The torque transfer device 124 may include, for example, a torque converter and/or one or more clutches. The transmission 122 may include, for example, a manual transmission, an automatic transmission, a semi-automatic transmission, an auto-manual transmission, or another suitable type of transmission.

Exhaust produced by combustion of the air/fuel mixture is expelled from the cylinder 108 via an exhaust valve 126. The exhaust is expelled from the cylinders to an exhaust system 128. The exhaust system 128 may treat the exhaust before the exhaust is expelled from the exhaust system 128. Although one intake and exhaust valve are shown and described as being associated with the cylinder 108, more than one intake and/or exhaust valve may be associated with each cylinder of the engine 102.

An engine control module (ECM) 130 controls the torque output of the engine 102 via various engine actuators. The engine actuators may include, for example, a throttle actuator module 132, a fuel actuator module 134, and a spark actuator module 136. The engine system 100 may also include other engine actuators, and the ECM 130 may control the other engine actuators.

Each engine actuator controls an operating parameter based on a signal from the ECM 130. For example only, the throttle actuator module 132 may control opening of the throttle valve 106 based on a signal from the ECM 130. The fuel actuator module 134 and the spark actuator module 136 may control fuel injection and spark timing, respectively, based on signals from the ECM 130.

The ECM 130 may control the torque output of the engine 102 based on driver inputs, one or more measured parameters, and inputs from various vehicle systems. The vehicle systems may include, for example, a transmission system, a hybrid control system, a stability control system, a chassis control system, and other suitable vehicle systems.

A driver input module 140 provides the driver inputs to the ECM 130. The driver inputs may include, for example, an accelerator pedal position (APP), a brake pedal position (BPP), cruise control inputs, and vehicle operation commands. An APP sensor 142 measures a position of an accelerator pedal (not shown) and generates the APP based on the position. A BPP sensor 144 monitors actuation of a brake pedal (not shown) and generates the BPP accordingly. A cruise control system 146 provides the cruise control inputs, such as a desired vehicle speed, based on inputs to the cruise control system 146. The vehicle operation commands may include, for example, vehicle startup commands and vehicle shutdown commands. The vehicle operation commands may be made via actuation of, for example, an ignition key, one or more buttons/switches, and/or one or more suitable vehicle operation inputs 148.

In vehicles having a manual transmission, the driver inputs provided to the ECM 130 may also include a clutch pedal position (CPP). A CPP sensor 150 monitors actuation of a clutch pedal (not shown) and generates the CPP accordingly. The clutch pedal may be actuated to couple the transmission 122 to the engine 102 and de-couple the transmission 122 from the engine 102.

In some implementations, the BPP sensor 144 and the CPP sensor 150 may measure the position of the associated pedal and generate the BPP and the CPP, respectively, based on the measured position of the associated pedal. In other implementations, the BPP sensor 144 and the CPP sensor 150 may each include one or more switches and may generate the BPP and the CPP, respectively, indicating whether the associated pedal is depressed relative to predetermined resting positions. While the APP sensor 142, the BPP sensor 144, and the CPP sensor 150 are shown and described, one or more additional APP, BPP, and/or CPP sensors may be included.

The ECM 130 selectively shuts down the engine 102 when a vehicle shutdown command is received. For example only, the ECM 130 may disable the injection of fuel, disable the provision of spark, and perform other engine shutdown operations to shut down the engine 102.

While the engine 102 is off, the ECM 130 may engage a starter motor 160 with the engine 102 for an engine startup event. For example only, the starter motor 160 may be engaged with the engine 102 when a vehicle startup command is received. The starter motor 160 may engage the flywheel 120 or one or more other suitable components that drive rotation of the crankshaft 116.

A starter motor actuator 162, such as a solenoid, selectively engages the starter motor 160 with the engine 102. For example only, the starter motor actuator 162 may selectively engage a starter pinion (not shown) with the flywheel 120. The starter pinion is coupled to the starter motor 160 via a driveshaft and a one-way clutch (not shown). A starter actuator module 164 controls the starter motor actuator 162 and the starter motor 160 based on signals from a starter control module 190.

The starter control module 190 selectively supplies current to the starter actuator module 164. When the starter control module 190 has supplied sufficient current to the starter actuator module 164, the starter actuator module 164 supplies current to the starter motor 160 to start the engine 102.

The application of current to the starter motor 160 drives rotation of the starter motor 160, and the starter motor 160 drives rotation of the crankshaft 116 (via the flywheel 120). Driving the crankshaft 116 to start the engine 102 may be referred to as engine cranking.

One or more batteries, such as battery 170, provide current to the starter motor 160. The engine system 100 may include one or more electric motors, such as electric motor (EM) 172. The EM 172 may selectively draw electrical power from the battery 170, for example, to supplement the torque output of the engine 102. The EM 172 may also selectively function as a generator and selectively apply a braking torque to generate electrical power. Generated electrical power may be used to, for example, charge the battery 170, provide electrical power to one or more other EMs (not shown), provide electrical power to other vehicle systems, and/or other suitable uses.

Once the engine 102 is deemed running after the engine startup event, the starter motor 160 may be disengaged from the engine 102, and current flow to the starter motor 160 may be discontinued. The engine 102 may be deemed running, for example, when engine speed exceeds a predetermined speed, such as a predetermined idle speed. For example only, the predetermined idle speed may be approximately 700 rpm or another suitable speed. Engine cranking may be said to be completed when the engine 102 is deemed running.

Other than starting and shutting down the engine 102 for commanded vehicle startups and vehicle shutdowns, the ECM 130 may selectively initiate auto-stop events and auto-start events of the engine 102. An auto-stop event includes shutting down the engine 102 when one or more predetermined enabling criteria are satisfied while the vehicle is on (e.g., while the ignition key is in an on position). For example, the ECM 130 may initiate an auto-stop event when the clutch pedal is depressed or when the brake pedal is depressed. During an auto-stop event, the engine 102 may be shut down and the provision of fuel to the engine 102 may be disabled, for example, to increase fuel efficiency (by decreasing fuel consumption).

While the engine 102 is shut down during an auto-stop event, the ECM 130 may selectively initiate an auto-start event. An auto-start event may include, for example, engaging the starter motor 160 with the engine 102, applying current to the starter motor 160 to start the engine 102, and providing fuel and spark to the engine 102. The ECM 130 may initiate an auto-start event, for example, when the driver begins to release the brake pedal.

The vehicle also includes a converter module 180 and one or more electronic devices 184. The converter module 180 is separate from the ECM 130. For example only, the electronic devices 184 may include a transmission control module, an instrument panel, audio devices, a body control module, and/or one or more electronic devices. The converter module 180 receives power from the battery 170 and provides power to the electronic devices 184 based on the power from the battery 170. The electronic devices 184 operate based on the power from the converter module 180.

Figure 2A:
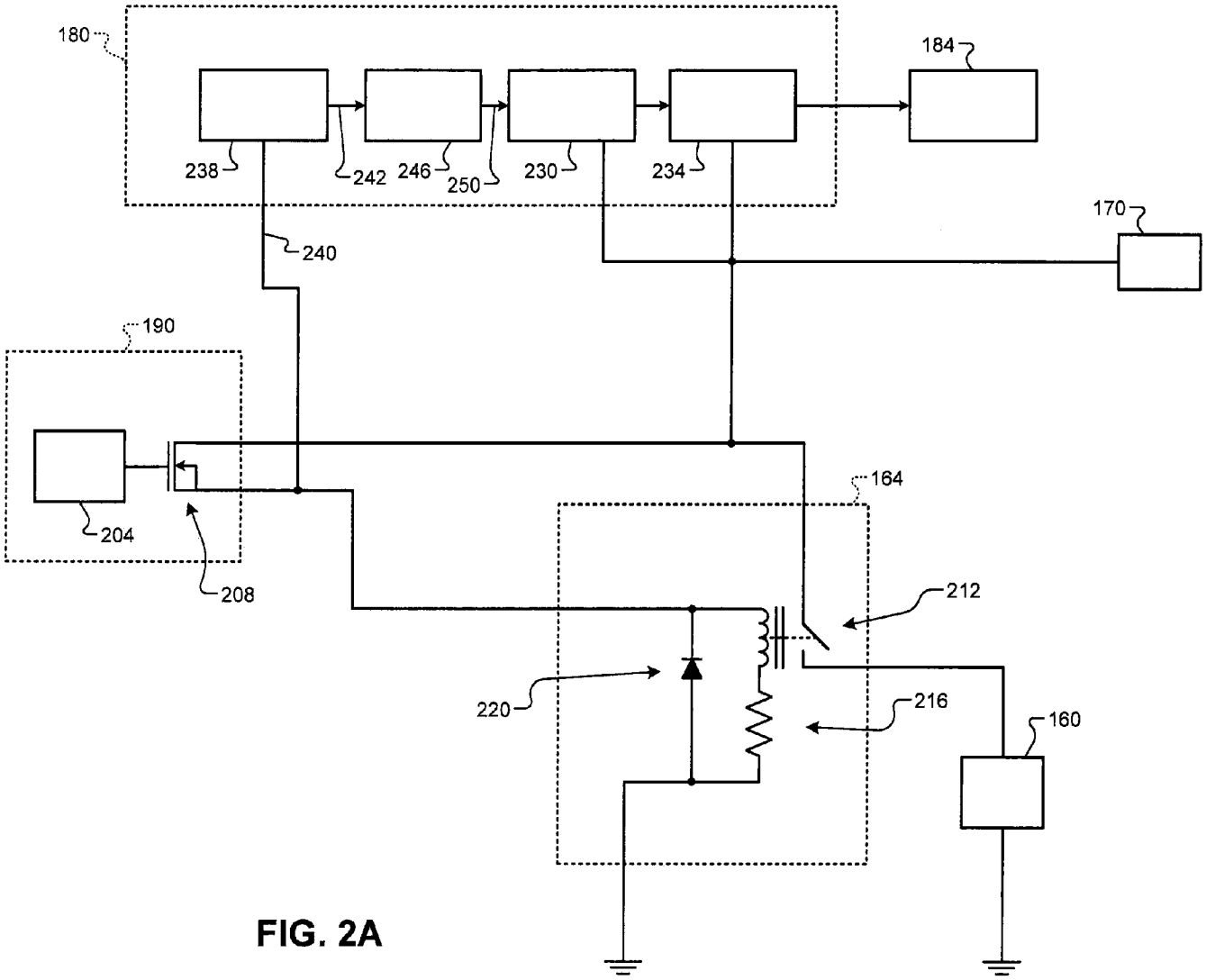
FIGS. 2A-2B are functional block diagrams of example starter and voltage control systems according to the present disclosure.

Referring now to FIG. 2A, a functional block diagram of an example starter and voltage control system is presented. The starter control module 190 may include a switch control module 204 and a switching device 208. A first terminal of the switching device 208 may be connected to the battery 170, and a second terminal of the switching device 208 may be connected to the starter actuator module 164.

Based on signals applied by the switch control module 204 to a control terminal of the switching device 208, the switching device 208 selectively connects and disconnects the first terminal to/from the second terminal. More specifically, the switching device 208 connects the first terminal with the second terminal when the signal applied by the switch control module 204 to the control terminal is in a first state. Current flows from the battery 170, through the switching device 208, to the starter actuator module 164 when the first terminal is connected with the second terminal. The switching device 208 disconnects the first terminal from the second terminal when the signal applied by the switch control module 204 is in a second state. In this state, the switching device 208 blocks current flow to the starter actuator module 164. For example only, the switching device 208 may include a metal oxide semiconductor field effect transistor (MOSFET) or another suitable type of switching device.

The starter actuator module 164 includes a relay 212 or another suitable type of switching device that switches relatively high currents using low current control. The relay 212 may be a mechanical relay, a solid state relay, or another suitable type of relay. A first terminal of the relay 212 is connected to the second terminal of the switching device 208. A resistor 216 may be connected between a second terminal of the relay 212 and a ground reference potential. A diode 220 may be connected in parallel with the relay 212 and the resistor 216, such as between the first terminal of the relay 212 and the ground reference potential.

The relay 212 opens and closes to control current flow to the starter motor 160. More specifically, the relay 212 closes and current flows from the battery 170 to the starter motor 160 when the relay 212 has received current from the switching device 208 for at least a first predetermined period. The relay 212 opens and blocks current flow to the starter motor 160 when the relay 212 has received current from the switching device 208 for less than the first predetermined period.

The converter module 180 includes a converter control module 230 and a voltage stabilization device 234. The voltage stabilization device 234 receives a first voltage from the battery 170. Based on signals received from the converter control module 230, the voltage stabilization device 234 converts the first voltage into a second voltage. The converter control module 230 may control the voltage stabilization device 234, for example, based on a target value for the second voltage. For example only, the converter control module 230 may control the voltage stabilization device 234 to adjust the second voltage toward the target value, for example, using closed-loop control. The target voltage may be greater than the first voltage. The voltage stabilization device 234 outputs the second voltage to the electronic devices 184. For example only, the voltage stabilization device 234 may be a DC to DC converter, such as a boost-type DC to DC converter. The electronic devices 184 operate based on the second voltage.

The first voltage decreases when current is supplied to the starter motor 160 to start the engine 102. Since the voltage stabilization device 234 generates the second voltage based on the first voltage, the voltage stabilization device 234 may be unable to adjust the second voltage to a target value if the decrease in the second voltage is not anticipated.

The converter module 180 also includes a filter module 238. The filter module 238 receives an output 240 (e.g., voltage or current) of the switching device 208 and applies one or more filters to the output to generate a filtered output 242. For example only, the filter module 238 may apply a low pass filter to the output 240 to generate the filtered output 242. While the example of a low pass filter is described, the filter module 238 may include an averaging filter, a band pass filter, a notch filter, and/or one or more other suitable filters.

A triggering module 246 generates a trigger signal 250 based on the filtered output 242. The trigger signal 250 indicates that the starter control module 190 will soon supply current to the relay 212 to close the relay 212 to start the engine 102. The engine 102 may be started, for example, for a vehicle startup event or for an auto-start event.

When the engine 102 is to be started, the switch control module 204 controls the switching device 208 to create a predetermined profile in the output 240 of the switching device 208. The predetermined profile is insufficient to close the relay 212 to supply current to the starter motor 160. However, the predetermined profile causes a change in the filtered output 242 that can be detected to trigger the converter control module 230 for the upcoming use of the starter motor 160.

Figure 3:
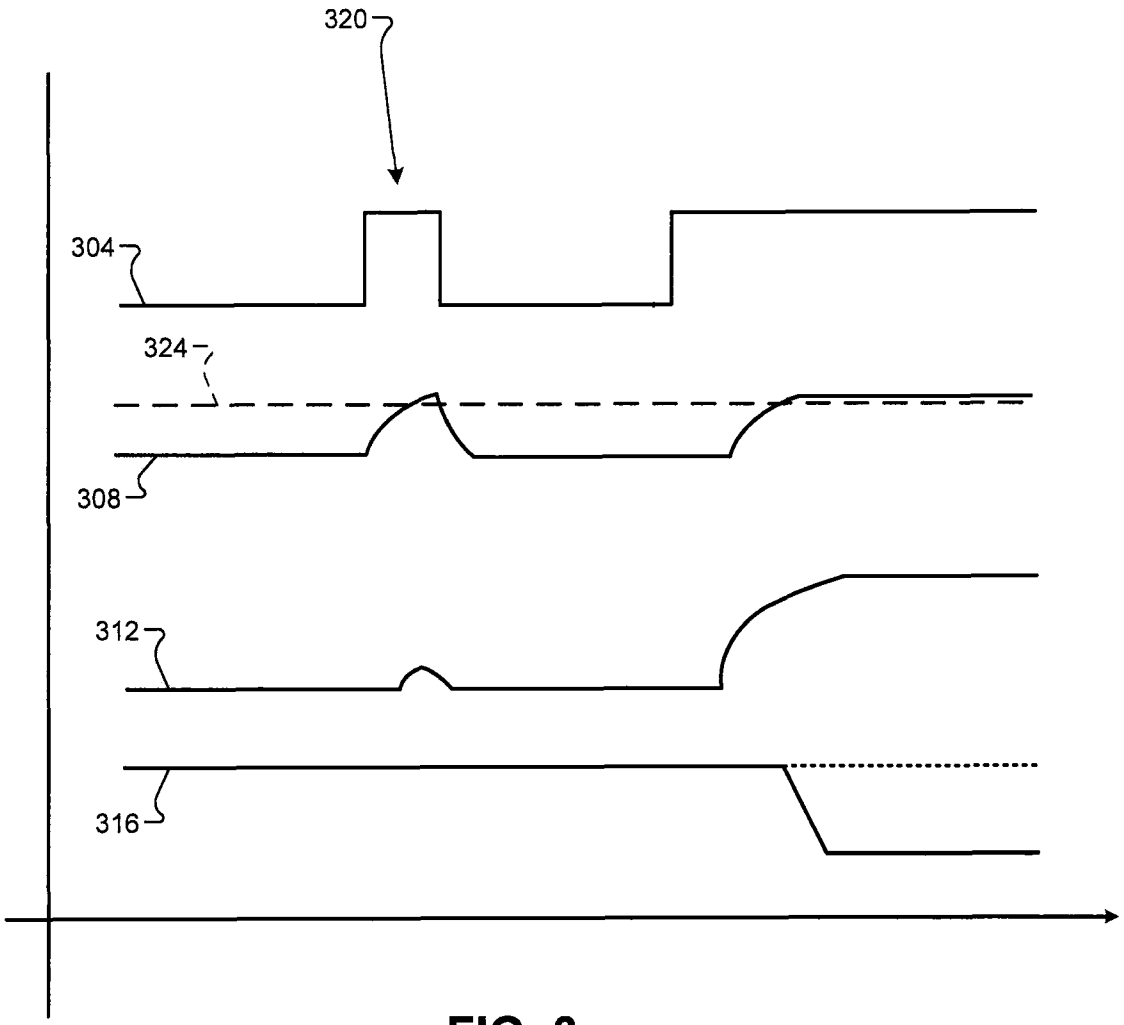
FIG. 3 is a graph including for various parameters versus time for an engine startup event including an example output of a switching device, an example of a filtered version of the output, an example of current flow through a starter relay, and an example of a battery voltage.

FIG. 3 is a graph including an example trace 304 of the output 240 of the switching device 208 for an engine startup event. The output 240 corresponds to the state of the signal applied by the switch control module 204 to the control terminal of the switching device 208. FIG. 3 also includes an example trace 308 of the filtered output 242, an example trace 312 of current through the relay 212, and an example trace 316 of the first voltage of the battery 170.

When a determination is made to start the engine 102, and before supplying current to the relay 212 to close the relay 212 to start the engine 102, the switch control module 204 transitions the signal applied to the control terminal of the switching device 208 to the first state, maintains the signal in the first state for a second predetermined period (on time), and transitions the signal to the second state. This creates a pulse in the output 240 of the switching device 208, for example, as indicated by example pulse 320.

The second predetermined period is less than the first predetermined period. As described above, the relay 212 closes when current is supplied to the relay 212 for greater than the first predetermined period. As such, the pulse generated in the output 240 does not cause the relay 212 to close, and the starter motor 160 does not yet receive current.

However, the pulse generated in the output 240 does cause a change in the filtered output 242. The triggering module 246 monitors the filtered output 242 and generates the trigger signal 250 based on the filtered output 242. For example only, the triggering module 246 may generate the trigger signal 250 when the filtered output 242 is greater than a predetermined value. The predetermined value is less than a second predetermined value above which the starter relay 212 closes. An example predetermined value 324 is provided in FIG. 3. The converter control module 230 prepares to begin controlling the voltage stabilization device 234 for the upcoming decrease in the first voltage when the trigger signal 250 is generated.

While the example of generating one pulse in the output 240 is described and shown, multiple pulses may be generated in various implementations. For example only, the switch control module 204 may generate multiple pulses in the output 240 that are insufficient to close the relay 212 by applying a PWM signal to the switching device 208. The length of these pulses, the period between the pulses, or another suitable indicator in the output 240 may be used to generate the trigger signal 250.

After transitioning the signal applied to the control terminal of the switching device 208 to the second state, the switch control module 204 may maintain the signal in the second state for a third predetermined period. The third predetermined period may be calibratable and set based on the period necessary for the converter control module 230 to be ready to control the voltage stabilization device 234 after the generation of the trigger signal 250.

After the third predetermined period, the switch control module 204 transitions the signal applied to the control terminal of the switching device 208 to the first state. The switch control module 204 maintains the signal in the first state to close the relay 212 and to start the engine 102. Once sufficient current has been applied to the relay 212, the relay 212 closes, and the starter motor 160 draws current from the battery 170 to start the engine 102. The first voltage therefore decreases as shown by the trace 316. The switch control module 204 may later open the switching device 208 when the engine startup event is complete, such as when the engine speed is greater than a predetermined speed.

The converter control module 230 monitors the first voltage and controls the voltage stabilization device 234 to adjust the second voltage toward the target value despite the decrease in the first voltage when the starter motor 160 starts the engine 102. For example, the converter control module 230 may apply PWM signals to switches of the voltage stabilization device 234 to control the conversion of the first voltage into the second voltage. The converter control module 230 may, for example, adjust the duty cycle of the signals applied to the voltage stabilization device 234 to adjust the second voltage toward its target value.

Figure 2B:
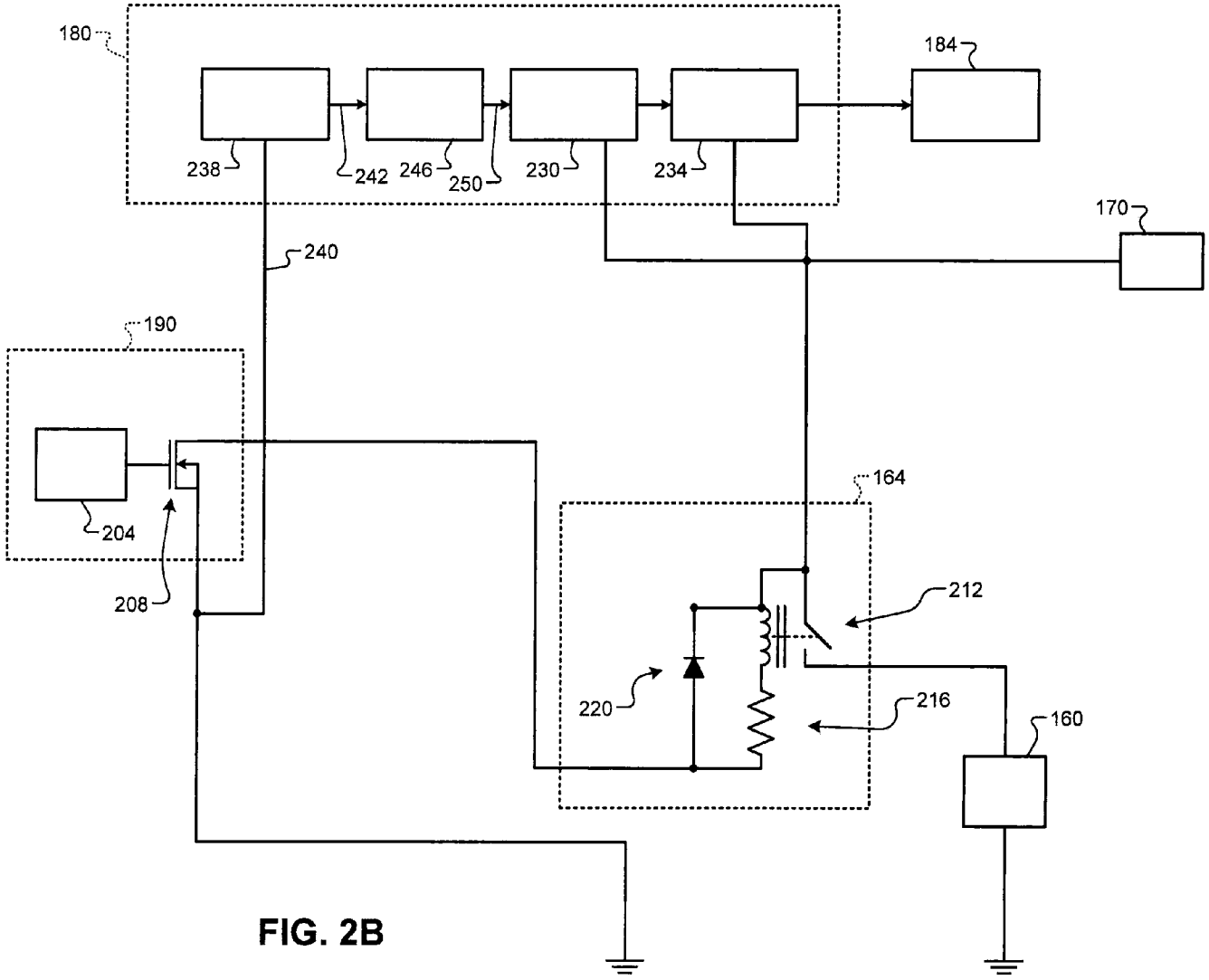

While FIG. 2A depicts an example high-side implementation, the present application is also applicable to low-side implementations. FIG. 2B includes an example low-side implementation.

Also, while the present application is described in conjunction with the converter module 180 preparing for pending actuation of the relay 212 based on the output 240 of the ECM 130, the present application is more generally applicable to a first module preparing for a pending action based on an output of a second module that is separate from the first module.

Figure 4:
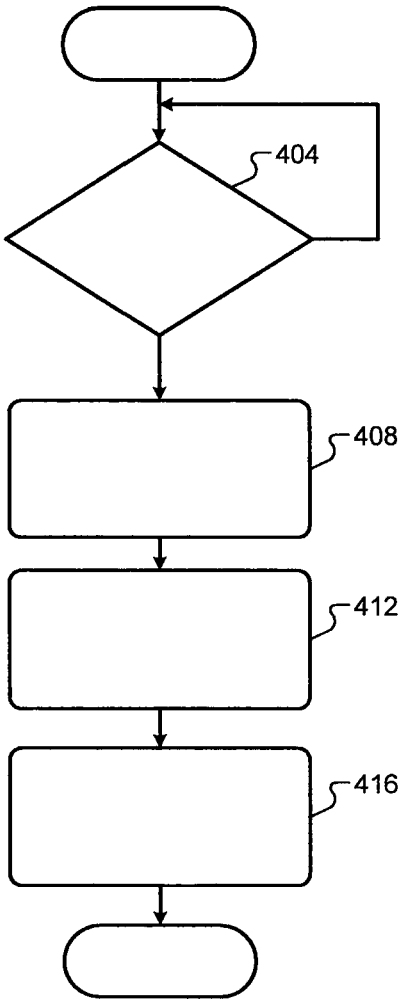
FIG. 4 is a flowchart depicting an example method of controlling power to a starter relay for an engine startup event according to the present disclosure.

Referring now to FIG. 4, a flowchart depicting an example method of controlling power to the starter relay 212 is presented. At 404, the switch control module 204 determines whether the engine 102 should be started. If 404 is true, control continues with 408. If 404 is false, control may remain at 404. For example, the switch control module 204 may determine that the engine 102 should be started when the driver inputs a vehicle startup command or when an auto-start event should be initiated.

At 408, the switch control module 204 selectively closes the switching device 208 to generate one or more pulses in the output 240. The pulse(s) indicate to the converter module 180 that the relay 212 will be closed within a predetermined period to start the engine 102. However, the pulse(s) are insufficient to close the relay 212.

At 412, the switch control module 204 maintains the switching device 208 in the open state for the third predetermined period. The converter control module 230 may wake and prepare to control the voltage stabilization device 234 while the switching device 208 is in the open state during the third predetermined period.

At 416, once the third predetermined period has passed, the switch control module 204 closes the switching device 208 and maintains the switching device 208 in the closed state. The switching device 208 therefore supplies current to the relay 212. The relay 212 closes, and the starter motor 160 draws current from the battery 170 to start the engine 102, when the switching device 208 has supplied sufficient current to the relay 212.

Figure 5:
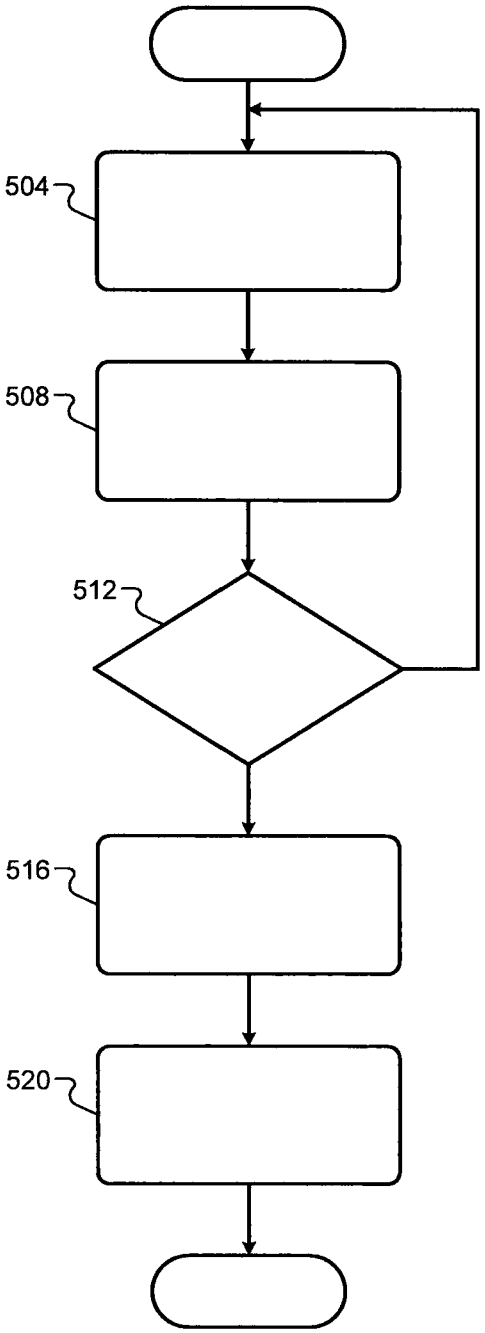
FIG. 5 is a flowchart depicting an example method of controlling a voltage stabilization device for an engine startup event according to the present disclosure.

Referring now to FIG. 5, a flowchart depicting an example method of controlling the voltage stabilization device 234 is presented. The example of FIG. 5 may be performed in parallel with performance of the example of FIG. 4. At 504, the filter module 238 receives the output 240 of the switching device 208. As discussed above, the switch control module 204 generates one or more pulses in the output 240 prior to supplying current to the relay 212 to close the relay 212 and to start the engine 102.

The filter module 238 applies one or more filters, such as a low pass filter, to the output 240 at 508 to generate the filtered output 242. At 512, the triggering module 246 determines whether the filtered output 242 is greater than the predetermined value. If 512 is true, control continues with 516. If 512 is false, control may return to 504 to continue monitoring the filtered output 242.

At 516, the triggering module 246 generates the trigger signal 250 to indicate the impending closing of the relay 212 to start the engine 102. The starter motor 160 draws current from the battery 170 when the relay 212 is closed. As the voltage stabilization device 234 generates the second voltage based on the first voltage from the battery 170, the decrease in the first voltage when the relay 212 is closed may cause a decrease in the second voltage. The electronic devices 184 operate based on the second voltage.

The converter control module 230 prepares to control the voltage stabilization device 234 when the trigger signal 250 is generated. At 520, the converter control module 230 monitors the first voltage from the battery 170 and controls the voltage stabilization device 234 based on the target value for the second voltage (i.e., the output voltage of the voltage stabilization device 234). By generating the trigger signal 250 in advance of closing the relay 212 to start the engine 102, the converter control module 230 can better control the voltage stabilization device 234 to minimize a decrease in the second voltage when the first voltage from the battery 170 decreases.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A starter control system for a vehicle, comprising:

a starter relay that connects a battery with a starter motor of an engine when in a closed state and that disconnects the starter motor from the battery when in an open state;

a switching device that provides current to the starter relay when in a closed state and that disables current flow to the starter relay when in an open state; and a switch control module that, for an engine startup event:

transitions the switching device to the closed state for a first predetermined period;

transitions the switching device to the open state for a second predetermined period after the first predetermined period; and transitions the switching device to the closed state for a third period after the second predetermined period, wherein the starter relay remains in the open state during the first predetermined period and transitions to the closed state when the switching device is in the closed state for the third period.

2. The starter control system of claim 1 further comprising the starter motor, wherein the starter motor drives a crankshaft of the engine when the starter relay is in the closed state.

3. A converter control system for the vehicle, comprising:

the starter control system of claim 1;

a voltage stabilization device that receives a first voltage from the battery and that generates a second voltage based on the first voltage; and an electronic device that operates based on the second voltage.

4. The converter control system of claim 3 further comprising:

a triggering module that generates a trigger signal based on an output of the switching device; and a converter control module that controls the voltage stabilization device when the trigger signal is generated.

5. The converter control system of claim 4 further comprising a filter module that receives the output of the switching device and that applies a filter to the output to generate a filtered output, wherein the triggering module generates the trigger signal based on the filtered output.

6. The converter control system of claim 5 wherein the triggering module generates the trigger signal when the filtered output is greater than a predetermined value.

7. The converter control system of claim 5 wherein the filter includes a low pass filter.

8. The converter control system of claim 4 wherein the converter control module controls the voltage stabilization device based on a target voltage.

9. The converter control system of claim 4 wherein the converter control module controls the voltage stabilization device based on the first voltage.

10. The converter control system of claim 3 wherein the voltage stabilization device includes a direct current (DC) to DC converter.

11. A method for a vehicle, comprising:

using a starter relay, connecting a battery with a starter motor of an engine when the starter relay is in a closed state and disconnecting the starter motor from the battery when the starter relay is in an open state;

using a switching device, providing current to the starter relay when the starter relay is in a closed state and disabling current flow to the starter relay when the starter relay is in an open state; and, for an engine startup event:

transitioning the switching device to the closed state for a first predetermined period;

transitioning the switching device to the open state for a second predetermined period after the first predetermined period; and transitioning the switching device to the closed state for a third period after the second predetermined period, wherein the starter relay remains in the open state during the first predetermined period and transitions to the closed state when the switching device is in the closed state for the third period.

12. The method of claim 11 further comprising, using the starter motor, driving a crankshaft of the engine when the starter relay is in the closed state.

13. The method of claim 11 further comprising, using a voltage stabilization device:

receiving a first voltage from the battery;

generating a second voltage based on the first voltage; and outputting the second voltage to an electronic device that operates based on the second voltage.

14. The method of claim 13 further comprising:

generating a trigger signal based on an output of the switching device; and controlling the voltage stabilization device when the trigger signal is generated.

15. The method of claim 14 further comprising:

applying a filter to an output of the switching device to generate a filtered output; and generating the trigger signal based on the filtered output.

16. The method of claim 15 further comprising generating the trigger signal when the filtered output is greater than a predetermined value.

17. The method of claim 15 wherein the filter includes a low pass filter.

18. The method of claim 14 further comprising controlling the voltage stabilization device based on a target voltage.

19. The method of claim 14 further comprising controlling the voltage stabilization device based on the first voltage.

20. The method of claim 13 wherein the voltage stabilization device includes a direct current (DC) to DC converter.

* * * * *